US005311826A

United States Patent [19]

Baggiani

[11] Patent Number: 5,311,826

[45] Date of Patent: May 17, 1994

[54] FURNISHING ELEMENT WITH FOLDABLE PANELS

[76] Inventor: Giuseppe Baggiani, Via Provinciale Castiglionese, Catiglione della Pescaia, Italy, 58043

[21] Appl. No.: 838,407

[22] PCT Filed: Sep. 17, 1990

[86] PCT No.: PCT/IT90/00076

§ 371 Date: Mar. 11, 1992

§ 102(e) Date: Mar. 11, 1992

[87] PCT Pub. No.: WO91/03965

PCT Pub. Date: Apr. 4, 1991

[30] Foreign Application Priority Data

Sep. 18, 1989 [IT] Italy ..... 48378 A/89

[51] Int. Cl.[5] ..... A47B 3/00

[52] U.S. Cl. ..... 108/166; 108/66

[58] Field of Search ..... 108/79, 66, 115, 119, 108/124, 111, 112, 113, 114

[56] References Cited

U.S. PATENT DOCUMENTS

| | | | |
|---|---|---|---|
| 927,773 | 7/1909 | Buel | 108/112 |
| 1,553,036 | 9/1925 | Foss | 108/112 |
| 1,852,914 | 4/1932 | Berta . | |
| 2,184,976 | 12/1939 | McFall | 108/66 X |
| 3,108,158 | 6/1964 | Sanchez | 108/79 X |
| 3,162,149 | 12/1964 | Hanson | 108/79 |
| 3,303,797 | 2/1967 | Mueller | 108/79 X |
| 4,580,776 | 4/1986 | Burkinshaw | 108/112 X |

FOREIGN PATENT DOCUMENTS

| | | | |
|---|---|---|---|
| 0257370 | 3/1988 | European Pat. Off. . | |
| 366112 | 12/1922 | Fed. Rep. of Germany . | |
| 1243356 | 6/1967 | Fed. Rep. of Germany . | |
| 697388 | 1/1931 | France . | |
| 2636819 | 3/1990 | France . | |
| 663478 | 12/1951 | United Kingdom | 108/115 |
| 2223401 | 4/1990 | United Kingdom . | |
| 8808681 | 11/1988 | World Int. Prop. O. . | |

*Primary Examiner*—Jose V. Chen

*Attorney, Agent, or Firm*—Wegner, Cantor, Mueller & Player

[57] ABSTRACT

The furnishing element with foldable panels of the disclosure comprises a support base to the top of which there is connected, by a hinge, at least one primary movable panel rotatable from a substantially vertical rest position to horizontal position, and carrying by a hinge connection at least one secondary movable panel which when the primary movable panel has attained its horizontal position can be rotated from a folded position in which it rests against the primary movable panel to a horizontal extended position coplanar with the primary movable panel, structure being provided for supporting the movable panel or panels in the horizontal position.

12 Claims, 3 Drawing Sheets

FURNISHING ELEMENT WITH FOLDABLE PANELS

This invention relates to a furnishing element with foldable panels, which can be opened to form a structure having an extended upper panel.

In many domestic, office and similar furnishing situations, there is a requirement for a furnishing element which can be reduced to a small overall size while at the same time is able to be extended to form a larger-sized structure in the case of need, to provide in particular a sufficiently extended top resting panel.

A further requirement of furnishing elements of this kind is to provide a top panel shape which can be varied according to the practical and aesthetic requirements of its use.

In the household, office and similar furnishing fields there is widespread use of tables or structures generally in the form of modular sectors which when not in use are of small overall size but which when necessary can be extended to offer a larger-sized panel.

The known designs, which comprise withdrawable, hanging or rotatable panels, do not however allow these panels to be further opened out once the overall movable panel has attained the horizontal position.

EP-A-0 257 370 discolses a folding table comprising a plurality of mutually-articulated panels which can be unfolded in an arc of a circle about the central vertical axis of the table, from a folded configuration in which the structure is flattened in a meridian plane with respect to the above axis. This structure does not allow any use of the table in folded position, or in a partially unfolded position, owing to the particular mutual articulation of the panels folded one against the other like a bellows. Moreover, this structure does not allow to obtain different furniture, providing a useful function also when folded or partially unfolded, associating similar elements.

There is therefore a requirement for a furnishing element with foldable panels which can be combined with any type of furniture unit or also with itself to thus represent a sectional unit, which can be folded into a compact form, in which configuration it still possesses special aesthetic characteristics, and can also be extended when necessary and to the extent required, even in the case in which several similar elements are combined.

These results are obtained by the present invention, which provides a furnishing element with foldable panels, comprising a support base to the top of which is connected, by hinge means, at least one primary movable panel rotatable from a substantially vertical rest position to a horizontal position, and carrying by a hinge connection at least one secondary movable panel which when the primary movable panel has attained its horizontal position can be rotated from a folded position in which it rests against the primary movable panel to a horizontal extended position coplanar with the primary movable panel, means being provided for supporting the movable panel or panels in the horizontal position wherein, in one embodiment, the primary movable panel hinged to the base carries, hinge-connected and articulated about an axis of rotation substantially transverse to the axis of rotation of the primary movable panel, two lateral secondary movable panels having an overall extension and shape equal to that of the primary movable panel to which they are connected, said furnishing elements being connected together to form a single structure comprising movable panels rotatable in several directions forming substantially a table.

When in their horizontally-lying extended position, the movable panels lie at the same height to define a single resting panel.

In a particular embodiment, the base comprises an upper fixed panel to which one or more primary movable panels are hinge-connected and rotatable from a rest position to a horizontally-lying raised position.

According to this embodiment, the furnishing element comprises at least one primary movable panel hinge-connected to the base panel, which primary movable panel carries, hinge-connected thereto, at least one secondary movable panel rotatable from a folded position, in which it rests against the primary movable panel, to a horizontally-lying extended position.

Two or more furnishing elements consisting of superposed movable panels are connected together to form a single structure comprising movable panels rotatable in several directions to form substantially a table when in their open position.

In preferred embodiments, the movable panels can have a profile which is substantially rectangular, substantially of circular sector form, or of another form according to the outer perimeter of each individual sector, the axis or axes of rotation of the superposed panels being substantially radial or parallel to each other, according to whether the furnishing element has a circular or rectangular symmetry.

The means for supporting the movable panel or panels in the horizontal position can consist of rigid props resting against the base to totally or partly support the weight of the relative movable panels, or can consist of articulated frames connected to the base and resting on the floor, they being movable between a closed position close to the base, and an open position below the relative movable panels when rotated into the horizontal position.

The furnishing element according to the invention can form part of a furnishing structure comprising a number of elements with fixed and movable panels, or can be assembled with analogous elements.

Further details will be apparent from the description of some embodiments of the invention given hereinafter by way of non-limiting example with reference to the accompanying drawings, in which.

Figure 1:
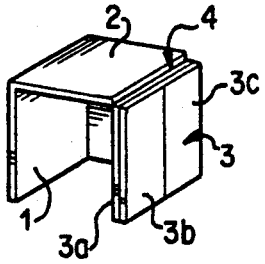
FIG. 1 is an isometric view of the structure of a furnishing element with foldable panels according to the invention, in the folded position.
Figure 2:
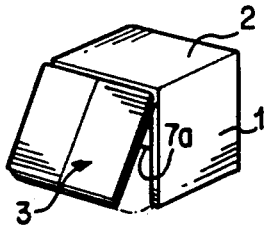
FIG. 2 shows the furnishing element of FIG. 1 with its superposed panels being raised from the vertical position to the horizontal position.
Figure 3:
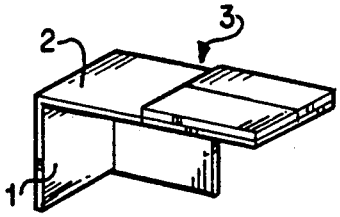
FIG. 3 shows the furnishing element of FIG. 1 with raising completed.

As can be seen from FIGS. 1 to 8, the furnishing element with foldable panels according to the invention comprises a base 1 which, in the construction illustrated by way of example only, consists of two panels intersecting at a right angle, at the top of which there is a fixed panel 2 of any shape, this being rectangular in the example.

To the outer side of the horizontal fixed panel 2 rigid with the base 1 there are connected, by means of hinges 4 or the like, movable panels 3 which are free to rotate about axes parallel to the side of the fixed panel 2. The movable panels 3 can lie in a vertical or inclined position below or above the fixed horizontal panel 2 (FIGS. 1 to 7).

The movable panels 3 comprise two or more superposed panels 3*a*, 3*b*, 3*c*, the lower of which, indicated in the figures by 3*a*, carries the hinges 4 which connect to the fixed horizontal panel 2, whereas the other or others 3*b*, 3*c* are connected to the movable panel 3*a* via hinges 5 provided along the axes of rotation.

The movable panels 3 have a shape such as to form overall, when in their rotated horizontal position, a continuous surface of side-by-side elements with the desired perimetral contour.

As can be seen in the figures, the overall movable panels can be moved into the horizontal position from any vertical or inclined position. When this operation has been concluded and the horizontal position attained, the upper movable panel or panels 3*a*, 3*b*, 3*c* can be rotated in any direction lateral or external to the structure.

Figure 4:
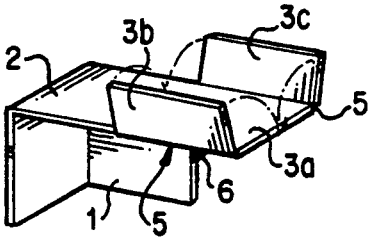
FIG. 4 shows the furnishing element of FIG. 1 with its upper rotatable panels undergoing opening.
Figure 5:
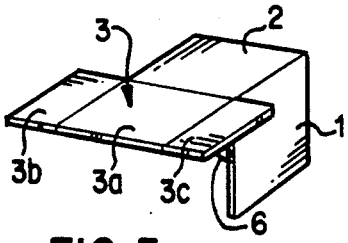
FIG. 5 shows the furnishing element of FIG. 1 completely opened.
Figure 6:
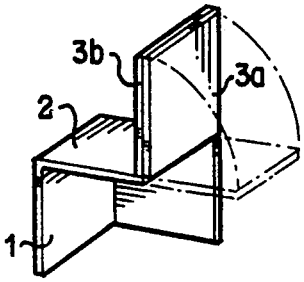
FIG. 6 is an isometric view of the structure of an alternative embodiment of the furnishing element with foldable panels according to the invention, in the vertical position, with two superposed panels disposed above the horizontal fixed panel.
Figure 7:
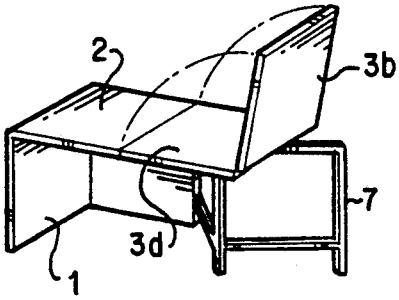
FIG. 7 is an isometric view of the structure of the furnishing element of FIG. 6 with the upper foldable panel in the process of being opened out, together with a support member resting on the floor.
Figure 8:
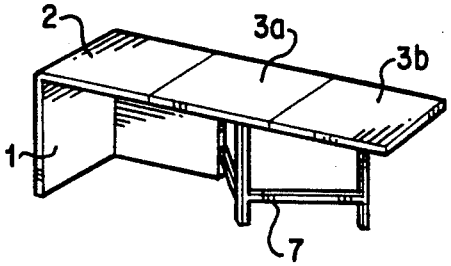
FIG. 8 is an isometric view of the structure of the furnishing element of FIG. 6 shown completely opened, and with the movable panels supported by a support member.
Figure 15:
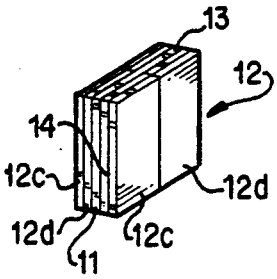
FIG. 15 is an isometric view in the closed position of a table embodiment composed of two combined furnishing elements with foldable panels, with their vertical movable panels parallel to each other and comprising a support base at its centre.
Figure 16:
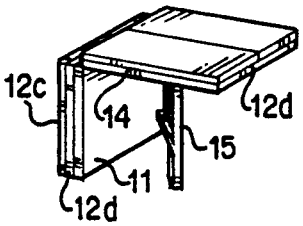
FIG. 16 is an isometric view of the table of FIG. 15 with one movable panel raised into the horizontal position and supported by a support member resting on the floor.
Figure 17:
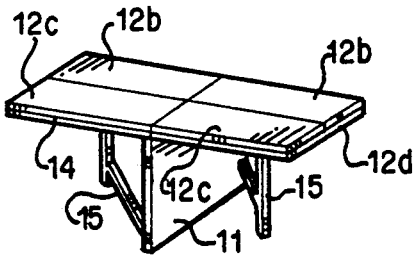
FIG. 17 is an isometric view of the table of FIG. 15 with both its movable panels raised into the horizontal position.
Figure 18:
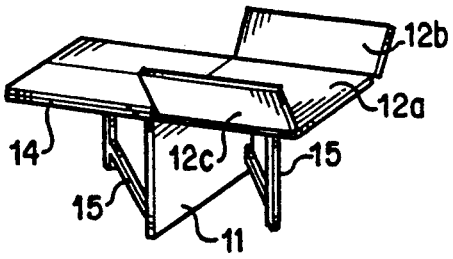
FIG. 18 is an isometric view of the table of FIG. 15 with its upper movable panels undergoing division.
Figure 19:
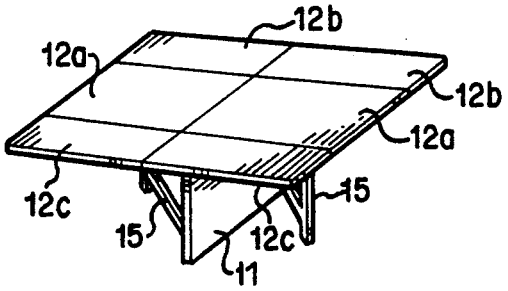
FIG. 19 is an isometric view of the table of FIG. 15 shwon completely opened.
Figure 9:
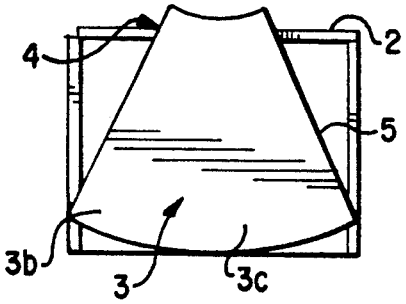
FIG. 9 is a front view of a further embodiment of a furnishing element according to the invention with its superposed panels, in the form of a circular sector, in the folded position.
Figure 10:
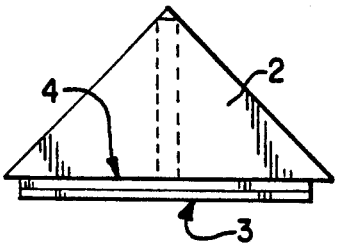
FIG. 10 is a plan view of the furnishing element of FIG. 9.

The movable panels 3*a* and possibly also the movable panel or panels 3*b*, 3*c* are kept in the horizontal position by support elements 6 rigid with the base 1, as shown in FIGS. 4 and 5, or by hinged supports 7 resting on the floor, these also being rigid with the base 1, as shown in FIGS. 7 and 8.

Further support members can be provided to keep the upper movable panels 3*b*, 3*c* in the horizontal position.

The support members for the movable panels 3, shown by way of example in FIGS. 4, 5, 7 and 8, can be of any type, either resting on the base or on other possible elements provided for this purpose.

The horizontal positioning of the overall movable panel 3 can be achieved manually.

As shown in FIGS. 9 to 14, the furnishing element with foldable panels according to the invention can also be used in a form such that it can be inserted into a corner or into a composite structure designed to furnish two walls forming a corner. In such an embodiment the furnishing element according to the invention comprise a base consisting of two panels intersecting at a right angle, at the top of which there is a fixed panel 2 of generally polygonal shape, this being triangular in the illustrated example.

To the outer side of the horizontal fixed panel 2 rigid with the base 1 there are connected movable panels 3, which are free to rotate about an axis parallel to the outer side of the fixed panel 2 by means of hinges 4 or the like. In this example the axes of rotation of the upper movable panels are substantially radial so that the panel can easily be extended, even when in a abnormal position such as a corner position.

The movable panels 3 are connected to the fixed panel 2 in proximity to the lower movable panel 3*a* and can lie in a vertical or partly inclined position under their own weight.

Figure 14:
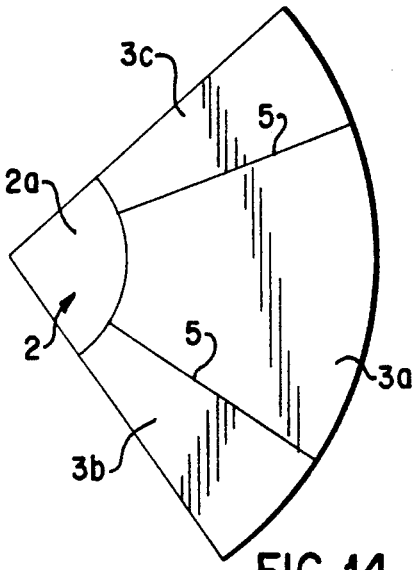
FIG. 14 is a plan view of the furnishing element of FIG. 9 in the completely open position.
Figure 13:
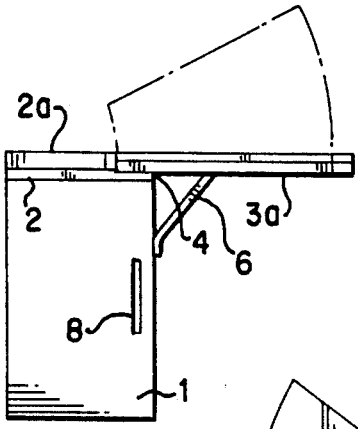
FIG. 13 is a side view of the furnishing element of FIG. 9, with the superposed movable panel assembly shown in the horizontal position.
Figure 11:
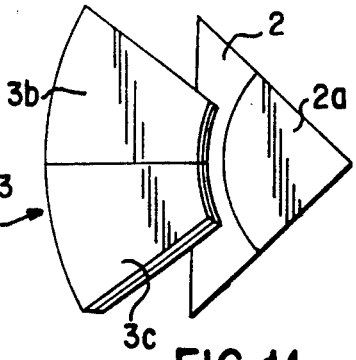
FIG. 11 is a plan view of the furnishing element of FIG. 9, with the superposed movable panel assembly shown undergoing raising.
Figure 12:
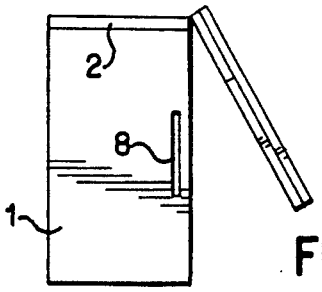
FIG. 12 is a side view of the furnishing element of FIG. 9, with the superposed movable panel assembly shown undergoing raising.
Figure 24:
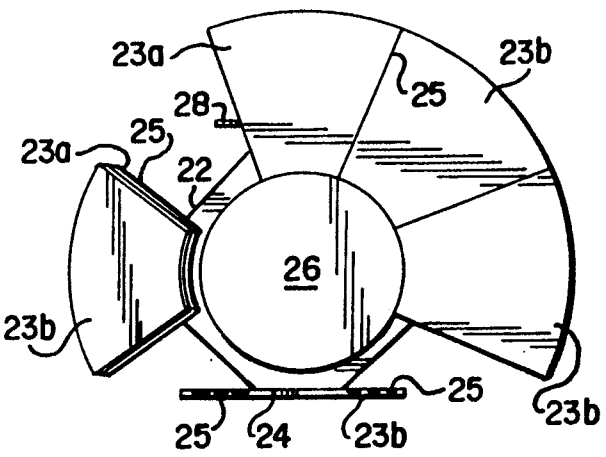
FIG. 24 is a plan view of the table of FIG. 23.
Figure 21:
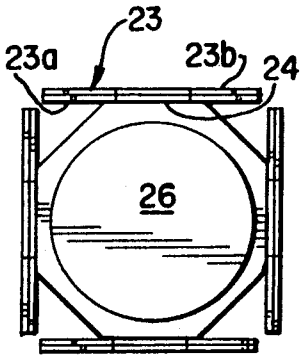
FIG. 21 is a plan view of the table of FIG. 20.

The movable panels 3 consist of two or more superposed elements, 3*a*, 3*b*, 3*c* in the example, one of which, indicated by 3*a* in the figures, carries the hinges 4 connecting to the fixed panel 2, whereas the others 3*b*, 3*c* are connected to the panel 3*a* via lateral hinges 5. The movable panel 3 has a shape such as to form overall, when in its horizontal position and the upper movable panels have been rotated, a continuous surface of side-by-side elements with the desired perimetral contour, for example in the form of a circular arc as shown in FIG. 14.

Above the fixed panel 2 there can be provided a further fixed panel 2*a* of thickness equal to that of the movable panels 3 and having a profile complementary to that of their upper edge. In the illustrated example the fixed panel 2*a* has a circular outer perimeter, the movable panels 3 consequently having a concave upper edge in the form of a circular arc.

As shown in the figures, the movable panels 3*a* can be raised into a horizontal position and kept in this position by suitable support members carried by the base or by the panels themselves, such as props 6.

Further props 8 or the like support the movable panels 3b, which can be rotated laterally about the respective hinges 5 relative to the movable panel 3a, to fill the spaces to the side of the panel 3a. The props 8 can also be carried by the panels 3a or by the base 1, or by both.

The support members for the movable panels 3a, which in the figures are represented by way of example as props 6, 8, can be of any type either resting directly on the floor or on further elements provided for this purpose.

FIGS. 15 to 19 show a further embodiment of the elements with foldable panels according to the invention, which provides an openable, extendable table comprising a base 11 consisting, in the embodiment illustrated by way of non-limiting example, of a flat element having a thickness equal to double the distance between the axis of rotation and the top of the overall foldable movable panels.

The movable panels 12 are connected along the major side of the base 11 such that they are free to rotate about axes parallel to the sides of the base 11 via hinges 13 or the like. The movable panels 12 are connected to the top of the base 11 and hang by their own weight in a vertical or partly inclined position.

The movable panels 12 consist of two or more superposed flat elements 12a, 12b, 12c, one of which, indicated by 12a in the figures, carries the hinges 13 connecting to the top of the base 11, whereas the other flat element or elements 12b, 12c are connected to the panel 12a by side hinges 14 arranged along the side edges of the panels, as shown in the figures, or more generally along the axes of rotation.

The movable panels 12 have an overall shape such that when they have been arranged in a horizontal position and rotated they form a continuous surface of side-by-side elements with a square or rectangular perimetral contour, depending on the number of superposed flat elements, their dimensions and the axis of rotation of the panels, this axis being positioned on any outer side of the lower movable panel 12a.

The movable panels 12a are kept in the horizontal position by hinged support elements 15 rigid with the base and arranged between the base and the raisable panels overall, to rest on the floor.

It is obviously possible to use only one half of the table by raising only one lower movable panel 12a and opening out only one or both of the upper panels 12b, 12c.

FIGS. 20 to 25 show a particular embodiment of the furnishing element with foldable panels according to the invention, which forms an extendable table.

In this embodiment the furnishing element with foldable panels according to the invention comprises a base 21 consisting, in the construction illustrated by way of example only, of two flat elements intersecting crosswise, at the top of which there is a fixed panel 22 of generally polygonal shape, this being octagonal in the illustrated example.

To the sides of the fixed panel 22 rigid with the base 21 there are connected, by means of hinges 24 or the like, movable panels 23 which are free to rotate about axes parallel to the sides of the fixed panel 22.

The movable panels 23 are connected to the fixed panel 22 in proximity to their upper edge, and lie in a vertical or partly inclined position under their own weight.

The movable panels 23 consist of two or more superposed elements, 23a, 23b, one of which, indicated by 23a in the figures, carries the hinges 24 connecting to the fixed panel 22, whereas the other 23b is connected to the panel 23a via lateral hinges 25.

The movable panels 23 have a shape such as to form overall, when in their horizontal position and rotated, a continuous surface of side-by-side elements with the desired outer perimetral contour, for example circular as shown in the figures.

Above the fixed panel 22 there is provided a further fixed panel 26 of thickness equal to that of the movable panels 23 and having a profile complementary to that of their upper edge. In the illustrated example the fixed panel 26 has a circular outer perimeter, the movable panels consequently having a concave upper edge in the form of a circular arc.

Figure 25:
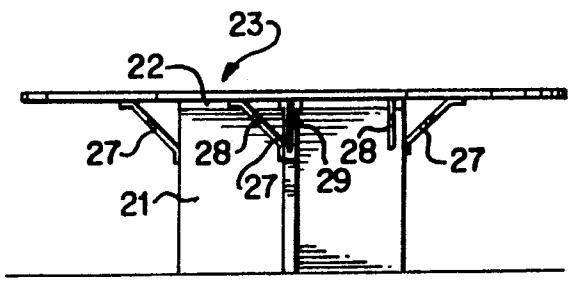
FIG. 25 is a side view of the table of FIG. 20, shown completely opened.
Figure 22:
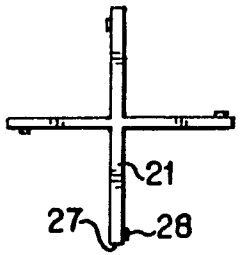
FIG. 22 shows the base of the table of FIG. 20.
Figure 23:
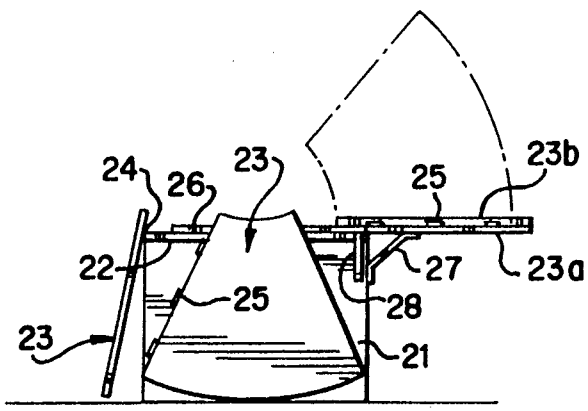
FIG. 23 is a side view of the table of FIG. 20 during its opening.
Figure 20:
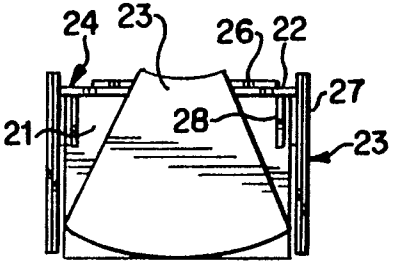
FIG. 20 is a side view in the closed position of a further particular table embodiment composed of foldable panels of circular sector form.

As shown in the figures, the movable panels 23a can be raised into a horizontal position and kept in this position by suitable support members carried by the base or by the panels themselves, such as props 27 visible in FIG. 25.

Further props 28 support the movable panels 23b, which can be rotated laterally about the respective hinges 25 relative to the panels 23a, to fill the intermediate spaces at the panels 23a. The props 28 can also be carried by the panels 23a or by the base, or by both.

The support members for the movable panels 23, which in the figures are represented by way of example as props 27 and 28, can be of any type, either resting on the base or resting directly on the floor or on further elements provided for this purpose.

In the present embodiment, as in those described and illustrated heretofore, the horizontal positioning of the movable . panels can obviously be achieved manually.

What is claimed is:

1. A furnishing element with foldable panels for forming a table, comprising:

a support base;

hinge means connected to a top portion of said support base;

at least one primary movable panel connected via said hinge means to said support base, said at least one primary panel being rotatable about a first axis of rotation from a substantially vertical rest position to a horizontal position;

at least two secondary movable panels having an overall size and shape substantially equal to that of said primary movable panel, said at least two secondary movable panels being hingedly connected to said at least one primary movable panel about a second axis of rotation substantially transverse to said first axis of rotation so that when the primary movable panel is in its horizontal position, said at least two secondary movable panels are rotatable from a folded position in which they rest against the primary movable panel to a horizontal position coplanar with the primary movable panel;

means for supporting said at least one primary movable panel and said at least two secondary movable panels in their horizontal positions;

wherein a plurality of said furnishing elements are selectively connectable together to form a single structure wherein each of said primary and secondary movable panels are arranged so as to be rotatable in a desired direction to form a table of a desired configuration.

2. A furnishing element as in claim 1, wherein said at least one primary movable panel and said at least two secondary movable panels are disposed at an equal height when in their horizontal positions so as to form a single resting panel.

3. A furnishing element as in claim 1, wherein said base includes a fixed panel to which one or more primary movable panels and hingedly connected.

4. A furnishing element as in claim 3, further comprising a second fixed panel disposed above said fixed panel, said second fixed panel having a thickness equal to a thickness of said at least two secondary panels and having a circumferential profile complementary to said at least two secondary panels.

5. A furnishing element according to claim 1, characterised in that the movable panels (3; 12) have a substantially rectangular contour.

6. A furnishing element as in claim 1, wherein said at least two secondary panels are shaped as a circular sector.

7. A furnishing element as in claim 1, wherein said table is substantially rectangular in shape and said axes of rotation of said at least two secondary panels are parallel to one another.

8. A furnishing element as in claim 1, wherein said table is substantially circular in shape and said axes of rotation of said at least two secondary panels extend radially.

9. A furnishing element as in claim 1, wherein said means for supporting said at least one primary movable panel and said at least two secondary movable panels in their horizontal positions includes rigid props resting against said base.

10. A furnishing element as in claim 1, wherein said means for supporting said at least one primary movable panel and said at least two secondary movable panels in their horizontal positions includes articulated frames connected to said base and resting on the floor, said articulated frames being movable between a closed position w herein said articulated frames are arranged below said base and an open position wherein said articulated frames are arranged below said primary movable panel and said at least two secondary movable panels.

11. A furnishing element as in claim 1, wherein said table is formed by a plurality of furnishing elements each have fixed and movable panels.

12. A furnishing element as in claim 1, wherein said table is assembled using identical furnishing elements.

* * * * *